US009261257B2

(12) United States Patent
Peck

(10) Patent No.: US 9,261,257 B2
(45) Date of Patent: Feb. 16, 2016

(54) WARNING LIGHTING SYSTEM USING LED BEACON ARRAYS WITH A SINGLE MASTER POWER SUPPLY

(71) Applicant: Dialight Corporation, Farmingdale, NJ (US)

(72) Inventor: John Patrick Peck, Manasquan, NJ (US)

(73) Assignee: Dialight Corporation, Farmingdale, NJ (US)

( * ) Notice: Subject to any disclaimer, the term of this patent is extended or adjusted under 35 U.S.C. 154(b) by 437 days.

(21) Appl. No.: 13/731,966

(22) Filed: Dec. 31, 2012

(65) Prior Publication Data

US 2014/0185280 A1 Jul. 3, 2014

(51) Int. Cl.

| | |
|---|---|
| ***F21V 7/04*** | (2006.01) |
| ***F21V 5/00*** | (2015.01) |
| ***F21V 7/00*** | (2006.01) |
| ***F21V 23/02*** | (2006.01) |
| *F21W 111/00* | (2006.01) |
| *F21Y 101/02* | (2006.01) |
| *F21Y 103/00* | (2006.01) |
| *F21S 2/00* | (2006.01) |

(52) U.S. Cl.

CPC ..... *F21V 5/00* (2013.01); *F21V 7/0008* (2013.01); *F21V 23/02* (2013.01); *F21S 2/00* (2013.01); *F21W 2111/00* (2013.01); *F21Y 2101/02* (2013.01); *F21Y 2103/003* (2013.01)

(58) Field of Classification Search

CPC ... F21V 7/0008; F21V 7/0016; F21V 7/0083; F21V 7/06; F21V 23/02; F21V 23/001; F21Y 2103/003; F21W 2111/00; F21W 2111/043; G08G 5/0004

See application file for complete search history.

(56) References Cited

U.S. PATENT DOCUMENTS

| | | | | |
|---|---|---|---|---|
| 5,806,965 | A * | 9/1998 | Deese | 362/249.04 |
| 2002/0114161 | A1 * | 8/2002 | Barnett | 362/282 |
| 2005/0018444 | A1 | 1/2005 | Todd | |
| 2006/0198141 | A1 | 9/2006 | Peck et al. | |
| 2007/0153520 | A1 | 7/2007 | Curran et al. | |
| 2009/0045933 | A1 | 2/2009 | Smith et al. | |
| 2009/0207605 | A1 | 8/2009 | Fields | |
| 2010/0156303 | A1 | 6/2010 | Wulff | |
| 2011/0121734 | A1 | 5/2011 | Pape | |
| 2012/0026718 | A1 | 2/2012 | Meyer | |
| 2012/0257385 | A1 | 10/2012 | Peck et al. | |
| 2012/0320586 | A1 | 12/2012 | Yip | |
| 2013/0100667 | A1 * | 4/2013 | Riendeau et al. | 362/240 |

OTHER PUBLICATIONS

PCT International Search Report and Written Opinion for PCT/US2013/78324, May 1, 2014, pp. 1-11.

Flight Light, "Instruction Manual, Precision Approach Path Indicator", May 20, 2011, pp. 9-12.

* cited by examiner

*Primary Examiner* — Y M Lee

(57) ABSTRACT

The present disclosure is directed to an obstruction lighting system for an elevated structure. In one embodiment, the obstruction lighting system for the elevated structure includes two obstruction light beacons that provide at a light output, wherein each one of the two obstruction light beacons comprises a plurality of light emitting diodes (LEDs) and at least one optic, wherein each one of the two light beacons provides at least a 180 degree light output in a horizontal direction for being operated together to provide a combined 360 degree light output in a horizontal direction.

16 Claims, 13 Drawing Sheets

WARNING LIGHTING SYSTEM USING LED BEACON ARRAYS WITH A SINGLE MASTER POWER SUPPLY

BACKGROUND

Obstruction light beacons are usually placed on varying styles of towers that have varying heights and configurations. Typically, the higher the tower the greater the lighting requirements. Obstruction light beacon systems are different from most other lighting systems in that they must output very high light intensity along the horizon so that obstructions are clearly marked for pilots to see. Obstruction light beacon systems must also have a very narrow vertical beam spread so that this very high light intensity is not directed downward into residential areas. In addition, obstruction light system requirements for towers normally require that light be output in a 360 degree fashion around the horizontal axis of the tower and that the obstruction lighting provide different intensity levels as a function of the ambient light level.

Currently, multiple obstruction lights are placed around the tower. However, due to current obstruction light designs each obstruction light fixture requires an independent power supply, cabling and monitoring. Each power supply, wiring and monitoring can add up to be a significant portion of the overall cost to install the obstruction lights on the tower.

In addition, obstruction lights are designed to provide a complete 360 degree coverage for each individual obstruction lights. However, when the obstruction light is mounted on the tower, some of the light may be blocked by the tower itself. As a result, some of the light output of the obstruction light and the power provided to drive the light output is wasted. Therefore, additional obstruction lights must be placed on the same level of the tower in order to provide light to horizontal angles where the light is blocked by the tower.

SUMMARY

In one embodiment, the present disclosure provides an obstruction lighting system for an elevated structure, e.g., a tower. In one embodiment, the obstruction lighting system for an elevated structure includes two obstruction light beacons that provide at least 1,500 candelas (cd) of light output, wherein each one of the two obstruction light beacons comprises a plurality of light emitting diodes (LEDs) and at least one optic, wherein each one of the two obstruction light beacons provides at least a 180 degree light output in a horizontal direction for being operated together to provide a combined 360 degree light output in a horizontal direction, wherein the at least one optic collimates light in a vertical axis to create a beam spread in the vertical axis of between 3 and 6 degrees, wherein a light intensity at 0 degrees vertical and +/−90 degrees horizontal is between 30% and 70% of the light intensity at 0 degrees vertical and 0 degrees horizontal for each one of the two obstruction light beacons, wherein the light intensity at 0 degrees vertical and 180 degrees horizontal is less than 10% of the light intensity at 0 degree vertically and 0 degrees horizontally for each one of the two obstruction light beacons and a single power supply for providing power to the two obstruction light beacons using a single set of wires that connects the two obstruction light beacons in series.

In one embodiment, the present disclosure provides a method for providing obstruction lighting on an elevated structure. In one embodiment, the method includes providing a single power supply, coupling a first obstruction light beacon to the tower to provide a 180 degree light output in a horizontal direction, coupling a second obstruction light beacon to the tower to provide a 180 degree light output in a horizontal direction, wherein the 180 degree light output in the horizontal direction of the first obstruction light beacon and the 180 degree light output in the horizontal direction of the second obstruction light beacon provides a combined 360 degree light output in the horizontal direction and connecting the first obstruction light beacon and the second obstruction light beacon to the single power supply in series via a single set of wires.

In one embodiment, the present disclosure provides a second embodiment of an obstruction lighting system for an elevated structure. The second embodiment of the obstruction light system for the elevated structure includes a first obstruction light beacon coupled to a first side of the tower, wherein the first obstruction light beacon provides a 180 degree light output in a horizontal direction, a second obstruction light beacon coupled to a second side of the tower, wherein the second obstruction light beacon provides a 180 degree light output in a horizontal direction, wherein the 180 degree light output in the horizontal direction of the first obstruction light beacon and the 180 degree light output in the horizontal direction of the second obstruction light beacon provide a combined 360 degree light output in the horizontal direction and a single power supply for providing power to the first obstruction light beacon and the second obstruction light beacon using a single set of wires that connects the first obstruction light beacon and the second obstruction light beacon in series.

BRIEF DESCRIPTION OF THE DRAWINGS

So that the manner in which the above recited features of the present disclosure can be understood in detail, a more particular description of the disclosure, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

DETAILED DESCRIPTION

As discussed above, current towers use multiple obstruction light beacons around a tower. However, due to current obstruction light beacon designs each obstruction light beacon requires an independent power supply and wiring. Each power supply and wiring can add up to be a significant portion of the overall obstruction lights installation cost on the tower.

In addition, obstruction light beacons are designed to deploy lights in a complete 360 degree coverage for each individual obstruction light beacon. However, when the obstruction light beacon is mounted on the tower, some of the light emitted by the beacon may be blocked by the tower itself and, therefore, more than one beacon is required for each level of the tower. This results in waste of the light output of the obstruction light and the power provided to drive the light output. Therefore, significant energy is wasted.

Previous obstruction lights typically had a single omni-directional light source such as an incandescent light bulb or strobe tube. A single omni-directional light source does not easily allow for emitting light in only a 180 degree horizontal light distribution. One embodiment of the present disclosure provides an obstruction lighting system for a tower that uses obstruction light beacons that use a precise optical design that provides a specific predetermined 180 degree light output in a horizontal direction. Thus, when two obstruction lights are placed around the tower at a common horizontal level, a single power supply (e.g., a master power supply) using a single set of wires may be used to power the multiple obstruction light beacons and still provide an even 360 degree light output in the horizontal direction around the tower. As a result, significant cost savings can be achieved due to the reduced costs to produce the obstruction light beacon, the reduced costs in power supplies that are deployed, reduced costs in the amount of wiring that is required and reduced energy costs in the amount of power that is consumed to operate the obstruction light beacons.

Figure 1:
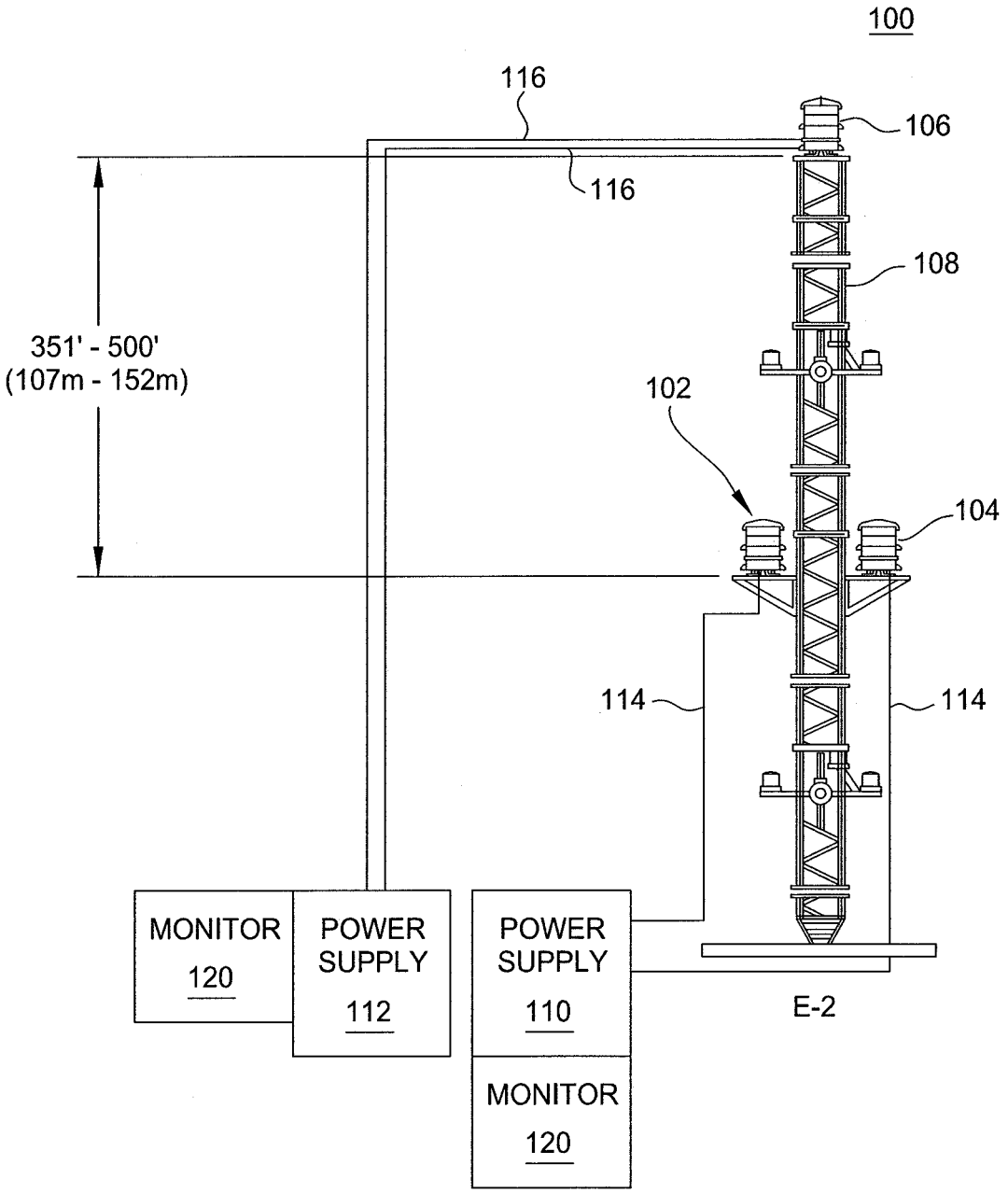
FIG. 1 depicts an example of an obstruction lighting system for a tower.

FIG. 1 illustrates an example of an obstruction lighting system 100 for an elevated structure, e.g., a tower 108 (or a smokestack, a structure deployed at the top of a building, e.g., a pole, or an antenna, and the like). In one embodiment, the tower 108 may be an "E-2" type of tower as defined by the Federal Aviation Administration (FAA). The tower 108 may require one or more obstruction lights 102, 104 and 106 for heights above 350 feet.

In one embodiment, the tower 108 may require medium intensity dual obstruction light beacons. In other words, the obstruction light beacons 102, 104 and 106 are capable of producing two different light outputs at two different intensities. For example, the first light may be a day time light that is a white color providing at least 15,000 candelas of light output so that the light can be seen by aircraft pilots during the day. The second light may be a night time light that is a red color and provides at least 1,500 candelas of light output so that the light can be seen by aircraft pilots at night.

In one embodiment, the obstruction light beacon at a top most level, e.g., the obstruction light beacon 106, may be a standard obstruction light beacon that provides a 360 degree light output in a horizontal direction. The obstruction light beacon 106 may be powered by a power supply 112 (e.g., a single independent power supply) with a set of wires 116. However, some levels of the tower 108 may require multiple obstruction light beacons to produce a 360 degree light output in a horizontal direction due to the tower 108 blocking the light. FIG. 1 illustrates obstruction light beacons 102 and 104 on a same horizontal level. Currently, each obstruction light beacon that is placed on the tower 108 produces a full 360 degree light output in the horizontal direction and each obstruction light beacon requires a separate power supply and separate wiring.

However, in one embodiment of the present disclosure, the obstruction light beacons 102 and 104 may be designed with LEDs and an optic so that each obstruction light beacon 102 and 104 only produces at least 180 degree light output in the horizontal direction and be powered by a single power supply 110. In one embodiment, the single power supply 110 may be referred to as a master power supply because the single power supply 110 powers both obstruction light beacons 102 and 104. In one embodiment, the optic may be a lens or a reflector.

Figure 9:
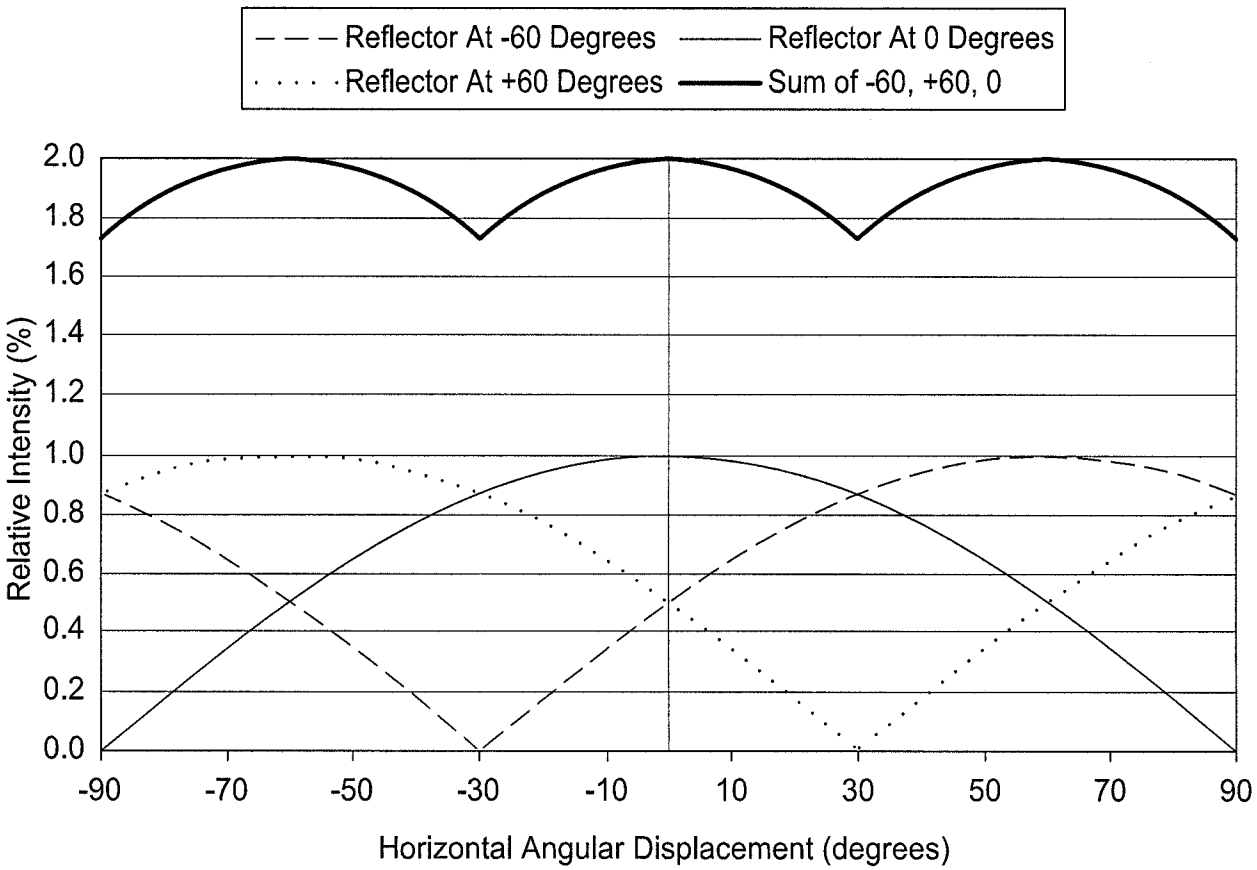
FIG. 9 depicts a chart of horizontal angular displacement versus relative intensity.
Figure 10:
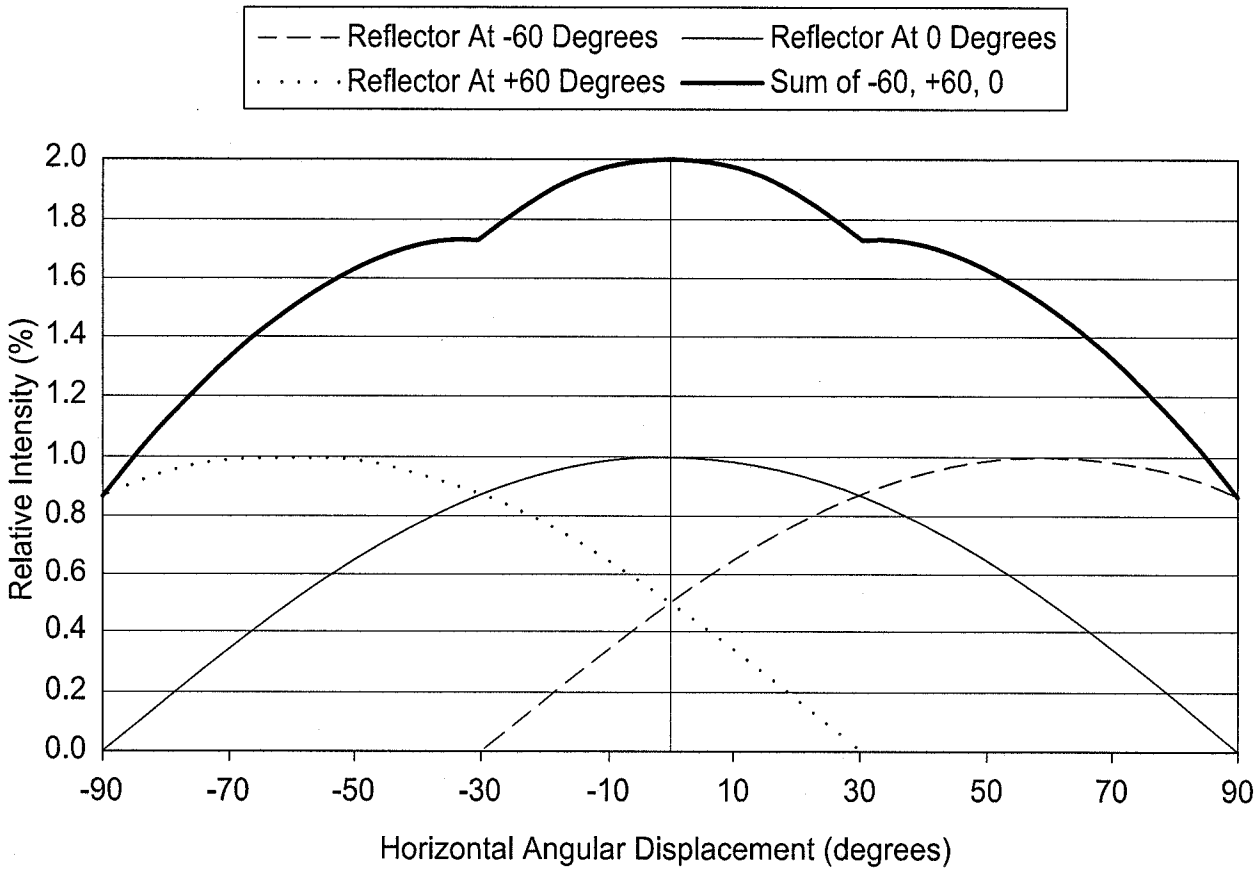
FIG. 10 depicts a second chart of horizontal angular displacement versus relative intensity.

FIG. 9 illustrates how the LED light emitted and reflected from the five of the six reflectors is combined to provide a fairly uniform light distribution around the horizontal angular distribution. In one embodiment, "uniform" may be defined as being within a predefined range as illustrated by example in FIG. 9. FIG. 10 illustrates how the LED light emitted and reflected from three of the six reflectors is combined but drops to about 50% at +/−90 degrees in the horizontal axis.

Figure 13:
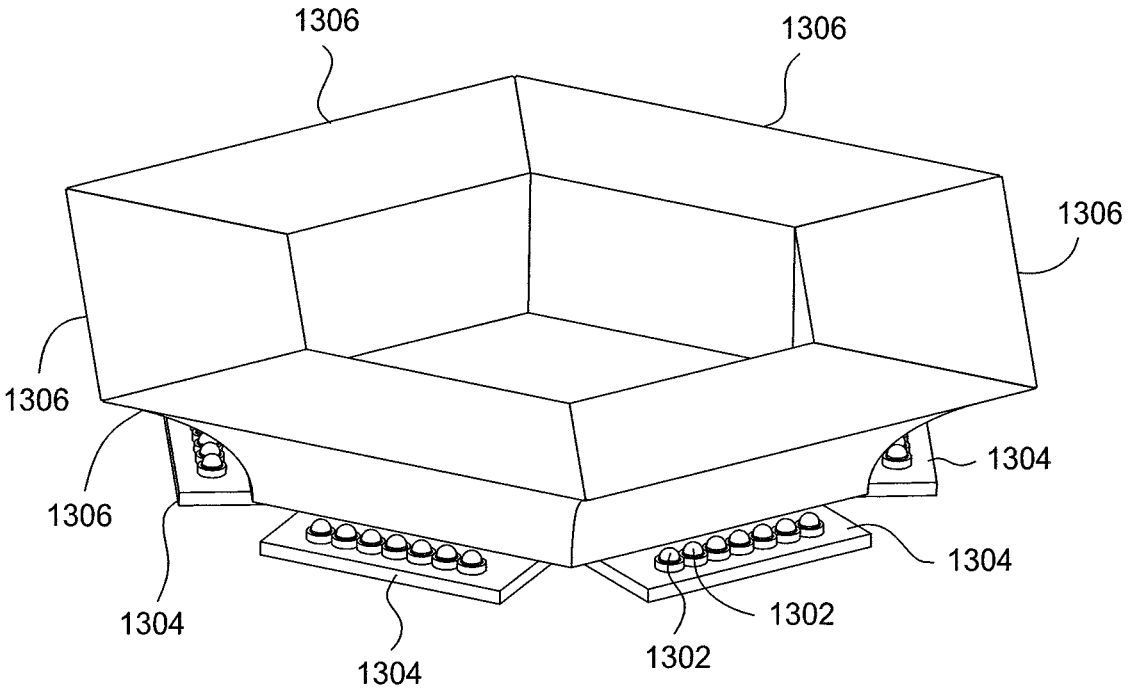
FIG. 13 depicts an example of a obstruction light beacon.

The six reflectors 1306 with respective LED arrays 1304 comprising a plurality of LEDs 1302 are shown in FIG. 13. In one embodiment, the LED arrays 1304 that provide the about 180 degree light output are positioned on one side of the beacon. In one embodiment, the LED arrays 1304 that provide the about 180 degree light output are positioned on one side of the beacon in the horizontal plane. In one embodiment, the LED arrays 1304 that provide the about 180 degree light output are positioned on one half of the beacon in the horizontal plane, e.g., corresponding to three or more adjoining reflectors out of the six (6) reflectors 1306 of FIG. 13.

Figure 11:
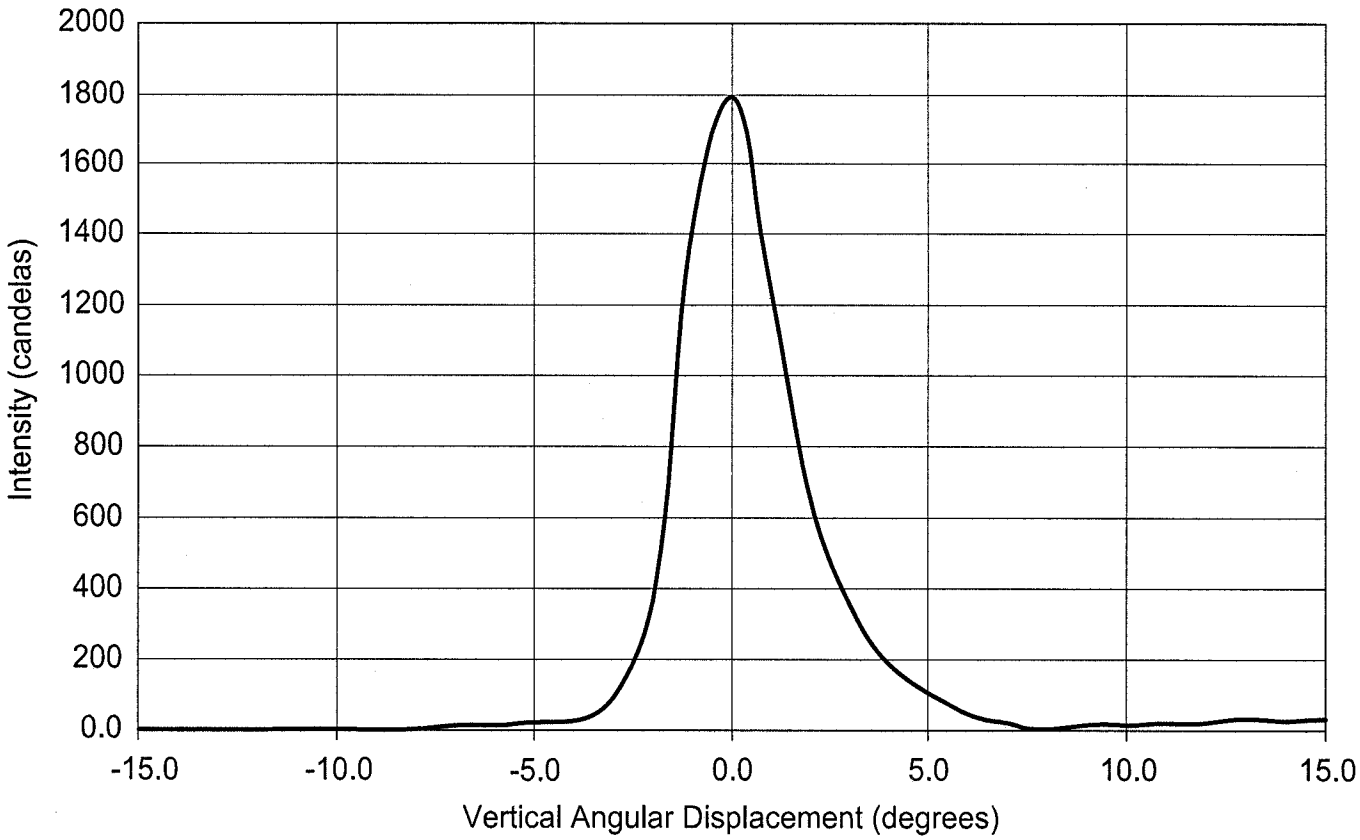
FIG. 11 depicts a chart of vertical angular displacement versus intensity.

The beam spread should be wide in the horizontal axis but should be very narrow in the vertical axis so that light is not wasted upward in the sky or downward toward the ground, but yet still can be seen by approaching aircraft. FIG. 11 shows how the resulting light distribution is collimated along the vertical axis to a beam spread of about 3 degrees when the LED light is emitted and reflected. In one embodiment, the vertical beam spread is between 3 and 6 degrees. In one embodiment, beam spread is defined as being the angle between the two directions opposed to each other over the beam axis for which the luminous intensity is half that of the maximum luminous intensity.

When operated together the optical designs of the obstruction light beacons 102 and 104 described herein may work together so that the combined light output produces a 360 degree uniform distribution in the horizontal direction, while being powered by a single power supply 110. The optic should be tailored for the obstruction light beacons 102 and 104 to achieve a uniform overlap around 360 degrees horizontal when the obstruction light beacons 102 and 104 are used together. In one embodiment, the light output should be between 180 degrees and 270 degrees for each of the obstruction light beacons 102 and 104 so that there are no horizontal angles of insufficient light output or excessive light output intensity when operated together. For example, when the obstruction light beacons 102 and 104 are operated together the combined light output at zero degree vertical and every angle around the horizontal should be at a specific intensity, such as 2,000 cd for example, plus or minus 25%.

Figure 12:
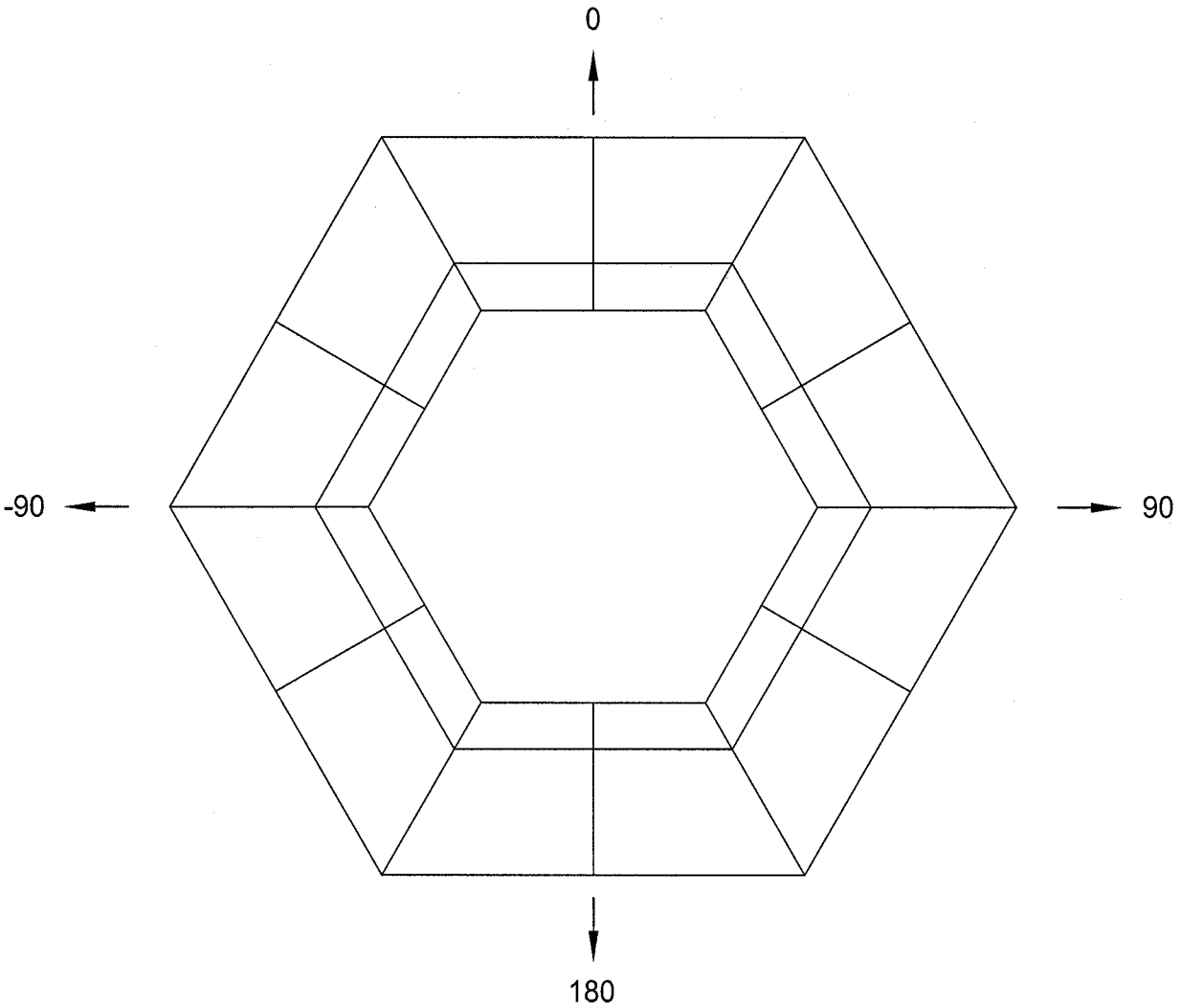
FIG. 12 depicts an example angles around a reflector.

The light output throughout the 180 degrees does not necessarily need to be constant for the obstruction light beacons 102 and 104 described herein. The light intensity at +/−90 degrees is of particular importance for each one of the obstruction lights 102 and 104. In order to provide a smooth light transition between the obstruction light beacons 102 and 104, the light intensity at 0 degrees vertical and +/−90 degrees horizontal is about 50% of the light intensity at 0 degrees vertical and 0 degrees horizontal. In one embodiment, the light intensity at 0 degrees vertical and +/−90 degrees horizontal is between 30% and 70% of the light intensity at 0 degrees vertical and 0 degrees horizontal for each of the obstruction light beacons 102 and 104. In one embodiment, there should be little or no light output at 180 degrees as this may be or may not be blocked by the tower and wasted depending on the physical construction of the various tower types. In one embodiment, the light intensity at 0 degrees vertical and 180 degrees horizontal is less than 10% of the light intensity at 0 degrees vertical and 0 degrees horizontal for each of the obstruction light beacons 102 and 104. FIG. 12 shows an illustration of these angles. In one embodiment, the cross section projection of at least one reflector is perpendicular to the light output at 0 degrees. In one embodiment, the obstruction lights have at least three optics sections. In one embodiment, the obstruction lights have at least three reflector sections. In one embodiment, the obstruction lights have at least three lens sections.

In one embodiment, a single power supply may be defined as all the circuitry and power sources needed to power and operate each different color output at each different intensity level of each one of the obstruction light beacons 102 and 104 within a single enclosure. In one embodiment, the power supply 110 provides a constant current output that feeds the one or more LEDs to both obstruction light beacons 102 and 104. In one embodiment, the power supply 110 provides the same constant current output to both obstruction light beacons 102 and 104. In one embodiment, the power supply provides a constant voltage output that feeds the one or more LEDs to both obstruction light beacons 102 and 104. In one embodiment, the circuitry of the single power supply may be placed on a single circuit board. In one embodiment, the circuitry of the single power supply may be placed on multiple circuit boards that are electrically connected together.

In addition, only a single set of wires 114 may be needed. In one embodiment, "a single set" may be defined as the wires running to and from a common power supply (e.g., a master power supply). In contrast, previous obstruction light systems required multiple sets of wires to and from separate power supplies powering separate obstruction light beacons that may be located on a common horizontal level. In one embodiment, a single set of wires may be defined as being two conductors. In another embodiment, a single set of wires may be defined as being three or more conductors.

In addition, only a single monitor 120 may be needed. In one embodiment, the monitor 120 may be defined as circuitry capable of monitoring and detecting failures, faults, health, or other problems with the LEDs of one of the obstruction light beacons 102 and 104 that may be located on a common horizontal level. In contrast, previous obstruction light systems required multiple monitors for monitoring separate obstruction light beacons that may be located on a common horizontal level.

Figure 2:
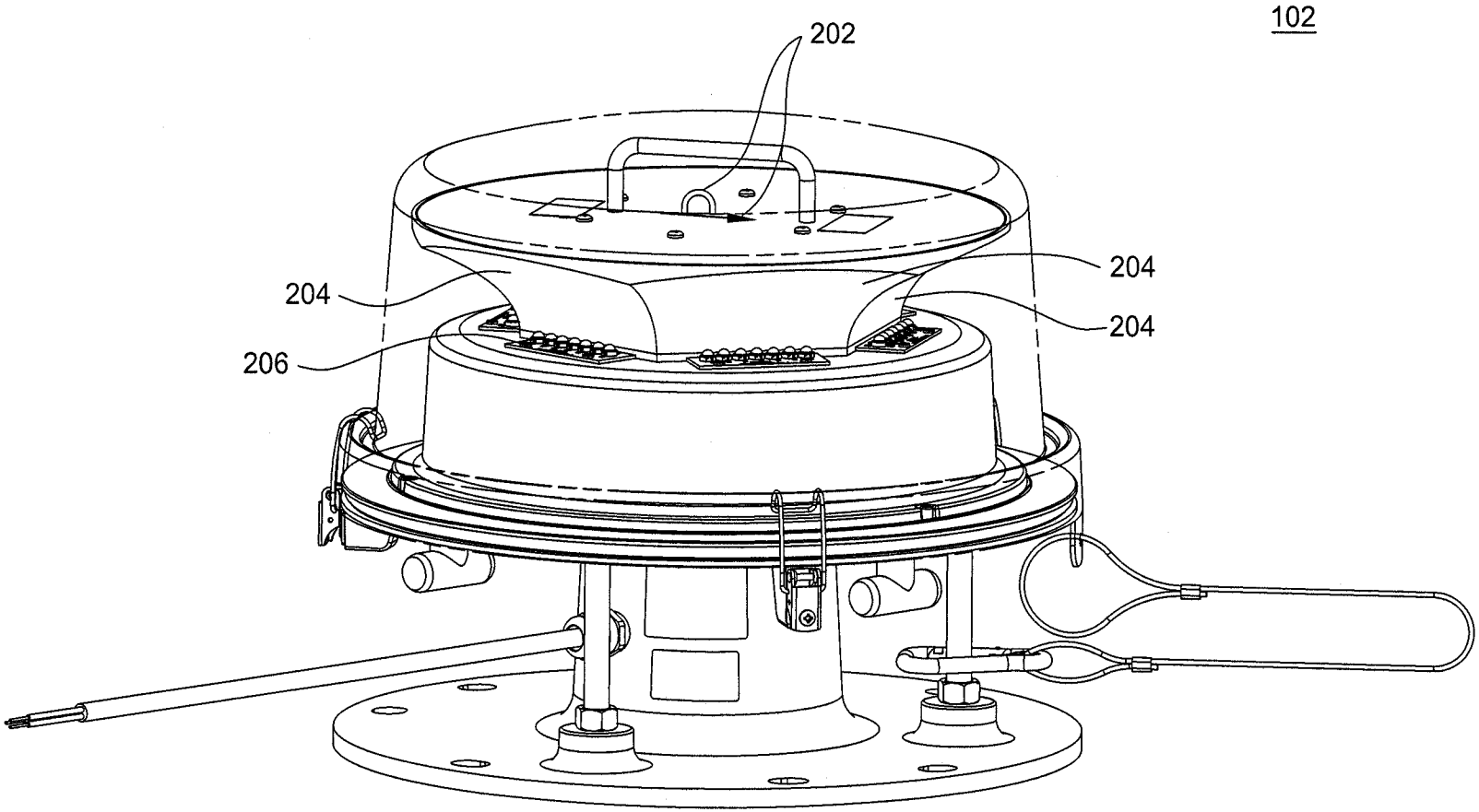
FIG. 2 depicts an example of an obstruction light beacon.

FIG. 2 illustrates one embodiment of the obstruction light beacons 102 and 104. It should be noted that the obstruction light beacons 102 and 104 are separate self contained units, each having their own LED arrays, optics, base portion, a dome portion, seals, and other hardware parts. In other words, the obstruction light beacons 102 and 104 are individual and separable units. In one embodiment, the obstruction light beacon 102 may include a plurality of conic, conic-like or parabolic curved reflectors 204 and a plurality of light emitting diode (LED) arrays 206. In one embodiment, the obstruction light beacon 102 may include a plurality of lenses and a plurality of LED arrays 206. In one embodiment, each one of the plurality of LED arrays 206 may comprise a plurality of LEDs arranged on approximately a line. In one embodiment, the plurality of LEDs may contain two different types of LEDs that emit two different colors. In one embodiment, the plurality of two different colored LEDs may be wired in different electrical circuits so that they may be operated independently.

In one embodiment, the number of LED arrays 206 may be about half that of the number of reflectors 204. In other words, half of the LED arrays 206 and associated electronics and hardware (e.g., drivers, circuit boards, and the like) may be removed from the obstruction light beacon 102 such that it only emits light 180 degrees horizontally around. As a result, the cost of the materials as well as the cost to manufacture the obstruction light beacon 102 may also be reduced in addition to achieving the energy savings. In one embodiment, all or at least more than half or all of the LEDs in the array 206 may be present, but only a subset of the LEDs is powered or used. In other words, the LED arrays 206 and associated electronics and hardware are not physically removed from the obstruction light beacon 102, but only a subset of the LEDs is used such that the beacon 102 only emits light 180 degrees horizontal. In one embodiment, two or more wiring options are present to allow the beacon 102 to provide power to all of the LEDs or to power a subset of LEDs and therefore provide either 360 degrees of coverage, 180 degrees of coverage, or some other angle that is less than 360 degrees of coverage in the horizontal axis.

The reflectors 204 may be curved to substantially collimate the light emitted by the array of LEDs 206. The array of LEDs 206 may be placed at a focal distance from the reflector 204 to achieve the high degree of collimation. In one embodiment, the obstruction light 102 is similar to the beacon light disclosed in U.S. patent application Ser. No. 11/300,700, assigned to Dialight® Corporation, which is hereby incorporated by reference in its entirety. One difference between the design of the beacon light in U.S. patent application Ser. No. 11/300,700 and the present obstruction light beacon 102 is that half of the LED arrays 206 are removed or are not utilized. However, the design of the reflectors 204 and placement of the LED arrays 206 may be identical.

In one embodiment, the obstruction light beacon 102 may include an alignment feature 202. The alignment feature 202 ensures that when two of the obstruction light beacons (e.g., the obstruction light beacons 102 and 104 in FIG. 1) are deployed on a tower, e.g., the tower 108, on approximately a same horizontal plane that the two obstruction light beacons 102 and 104 will operate together to produce a combined generally uniform 360 degree light output in the horizontal axis. It should be noted that in some cases the two obstruction light beacons 102 and 104 may not be mounted on exactly the same plane due to physical limitations on the tower. In one embodiment, the two obstruction light beacons 102 and 104 may not be mounted on approximately the same plane. In one embodiment, the two obstruction light beacons 102 and 104 may be mounted near each other but not on the exact same plane.

The alignment feature 202 is for providing a consistent light output around 360 degrees horizontal. For example, if the two obstruction light beacons 102 and 104 are not properly aligned, a portion of the light output of the two obstruction light beacons 102 and 104 may not overlap properly to provide consistent light output around 360 degrees in a horizontal direction. Consequently, the combined light output would be too high or too low at certain horizontal directions.

In one embodiment, the alignment feature 202 may be a cooperative alignment feature, such as a precise, but simple alignment icon (e.g., an arrow) that needs to be lined up with another alignment icon of a second obstruction light beacon. In another embodiment, the alignment feature 202 may be an independent alignment feature, such as laser or non-optical indicator. The non-optical indicators may include, for example, a magnetic indicator (e.g., a compass), an electronic non-optical indicator or a global positioning satellite (GPS) module. For example, this would be beneficial if the obstruction light beacons 102 and 104 are deployed on a solid tower (e.g., a smokestack) where the obstruction light beacons 102 and 104 are not in view of one another. As a result, the non-optical indicator may be used to simply point each of the obstruction light beacons 102 and 104 in an appropriate direction to ensure that the combined light output of the obstruction light beacons 102 and 104 are 360 degrees in a horizontal direction. In one embodiment, the alignment feature may be any mechanical member of the obstruction light beacon 102. In one embodiment, the alignment feature may be any mechanical or non-mechanical feature of a first obstruction light beacon 102 that may provide an angular reference with respect to a second obstruction light beacon 104.

The cooperative alignment feature may be permanently fixed or temporarily fixed to the obstruction light beacons 102 and 104. The angle of the cooperative alignment feature may be determined visually or may be remotely sensed through a wire or wirelessly.

Figure 3:
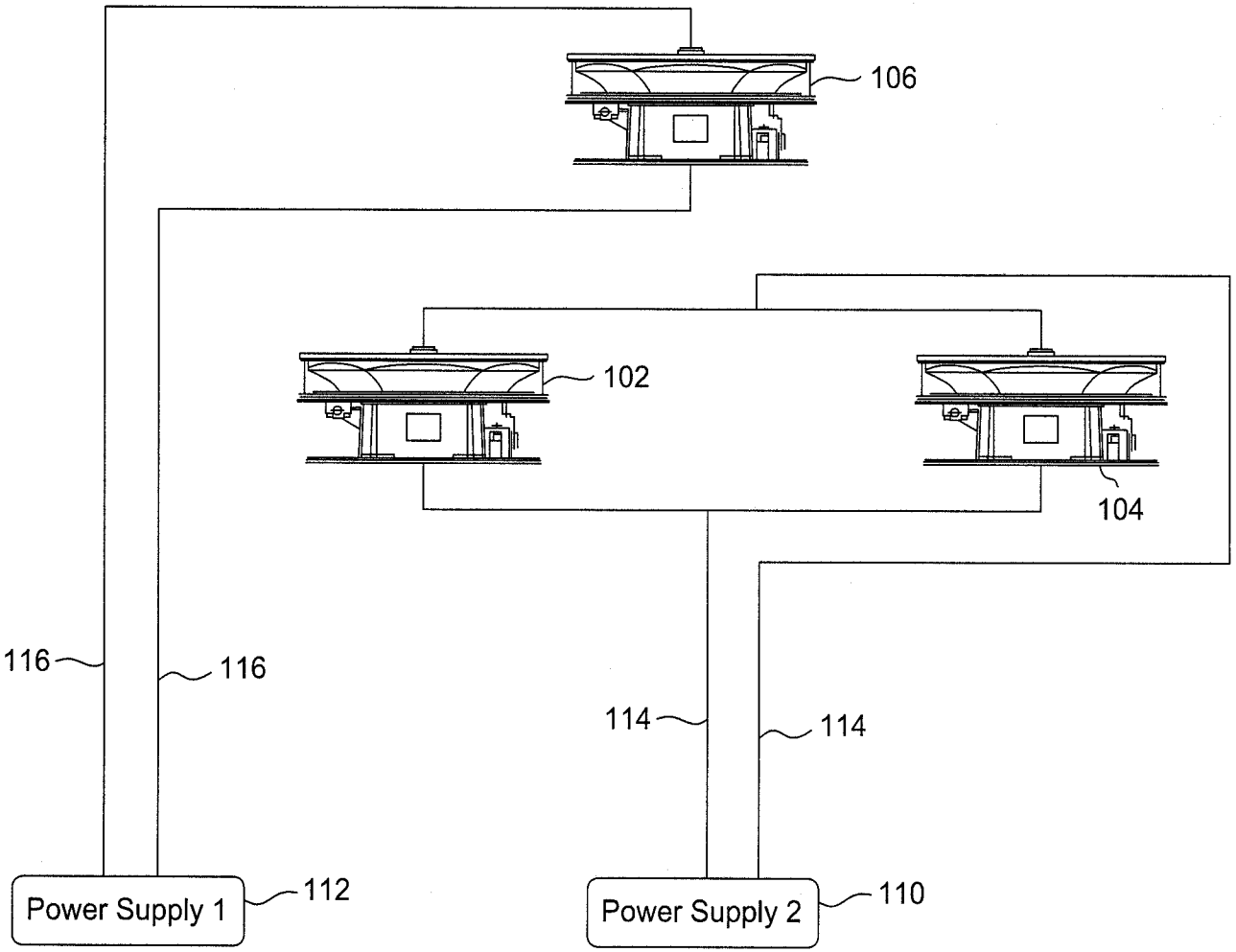
FIG. 3 depicts a first example wiring diagram of the obstruction light beacons in the obstruction lighting system.

FIG. 3 illustrates an example wiring diagram of the obstruction light beacons 102, 104 and 106 in the obstruction lighting system 100. FIG. 3 illustrates how in one embodiment, the obstruction light beacons 102 and 104 may be electrically connected in parallel to the single or master power supply 110 using a single set of wires 114. As noted above, the obstruction light beacon 106 may be wired using the power supply 112 and the set of wires 116.

Figure 4:
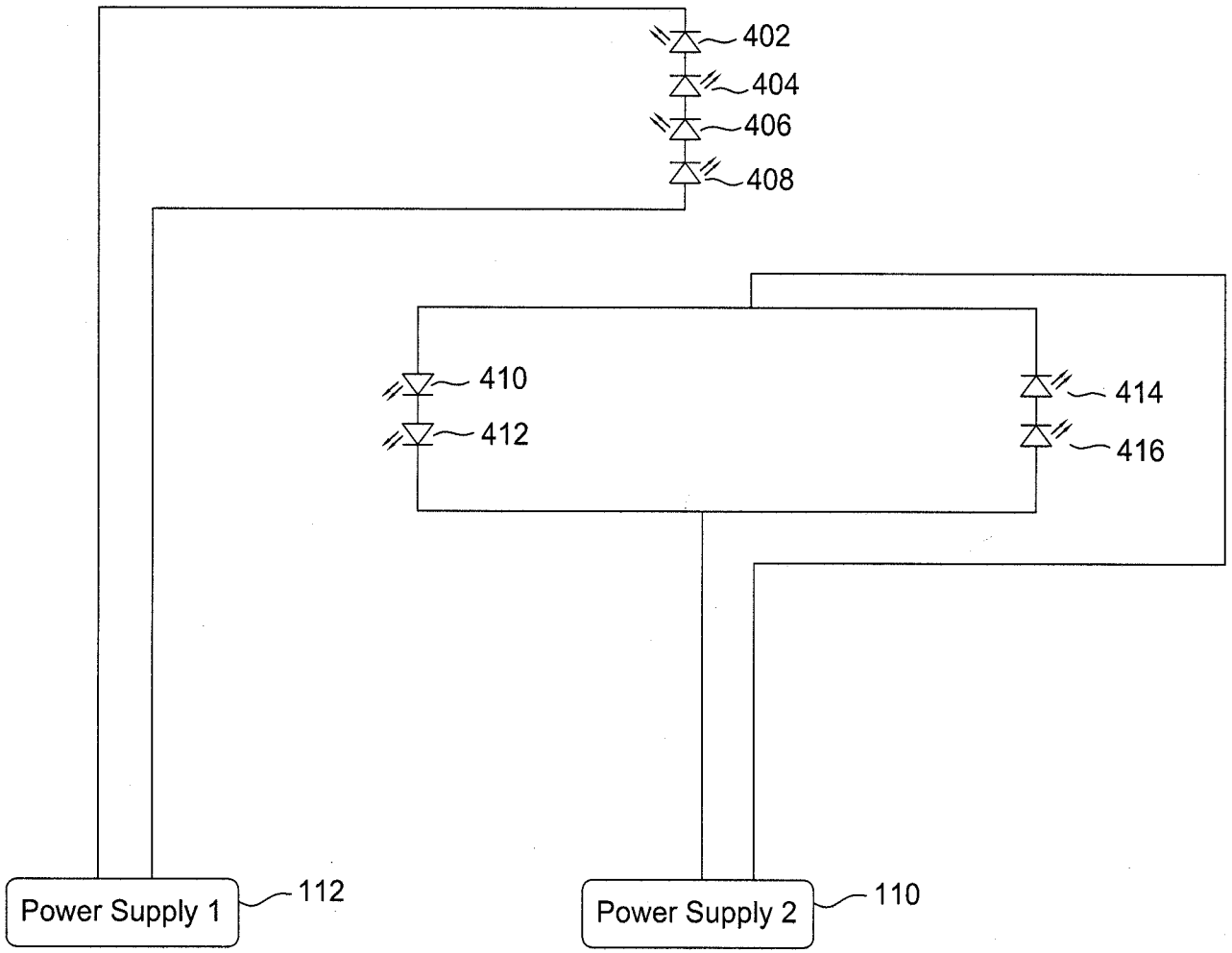
FIG. 4 depicts a first example wiring diagram of LEDs in the obstruction lighting system.

FIG. 4 illustrates how in one embodiment, the LEDs 410-416 of the obstruction light beacons 102 and 104 may be electrically connected in parallel to the single or master power supply 110 using a single set of wires 114. As illustrated in FIG. 3, a wiring diagram out of the power supply 110 may be split into both obstruction light beacons 102 and 104. The connection may then be recombined into a single wire that runs back to the power supply 110. The wiring configuration in FIG. 3 still allows a failure or outage of any one of the obstruction light beacons 102 and 104 to be detected. The failure may be detected by measuring the LED array voltage, LED array current, or a combination of the LED array voltage and current. A failure may be determined by detecting on open circuit or short circuit of the LED array.

Figure 5:
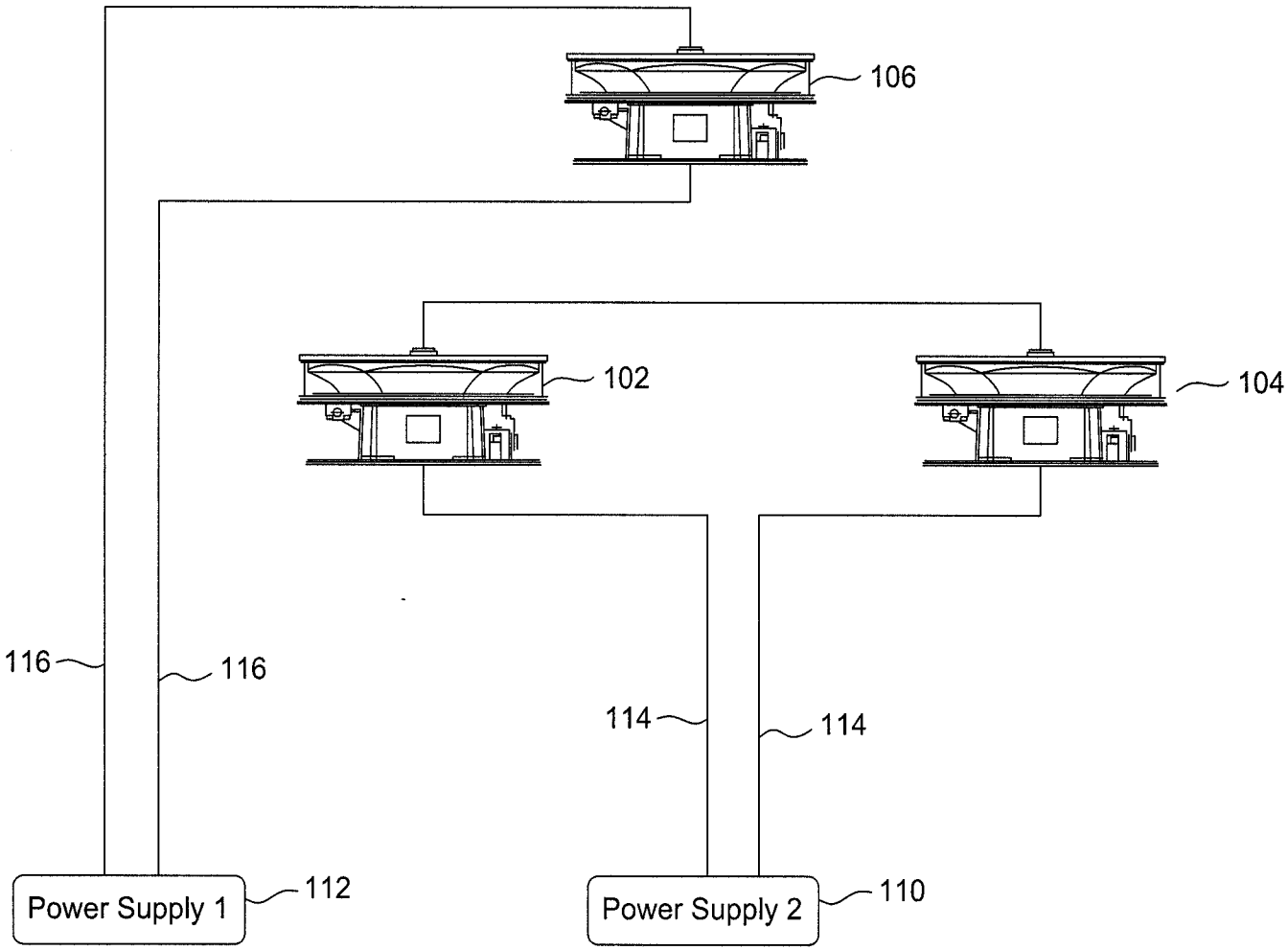
FIG. 5 depicts a second example wiring diagram of the obstruction light beacons in the obstruction lighting system.

FIG. 5 illustrates an example wiring diagram of the obstruction light beacons 102, 104 and 106 in the obstruction lighting system 100. FIG. 5 illustrates how in one embodiment, the obstruction light beacons 102 and 104 may be electrically connected in series to the single or master power supply 110 using a single set of wires 114. As noted above, the obstruction light beacon 106 may be wired using the power supply 112 and the set of wires 116.

Figure 6:
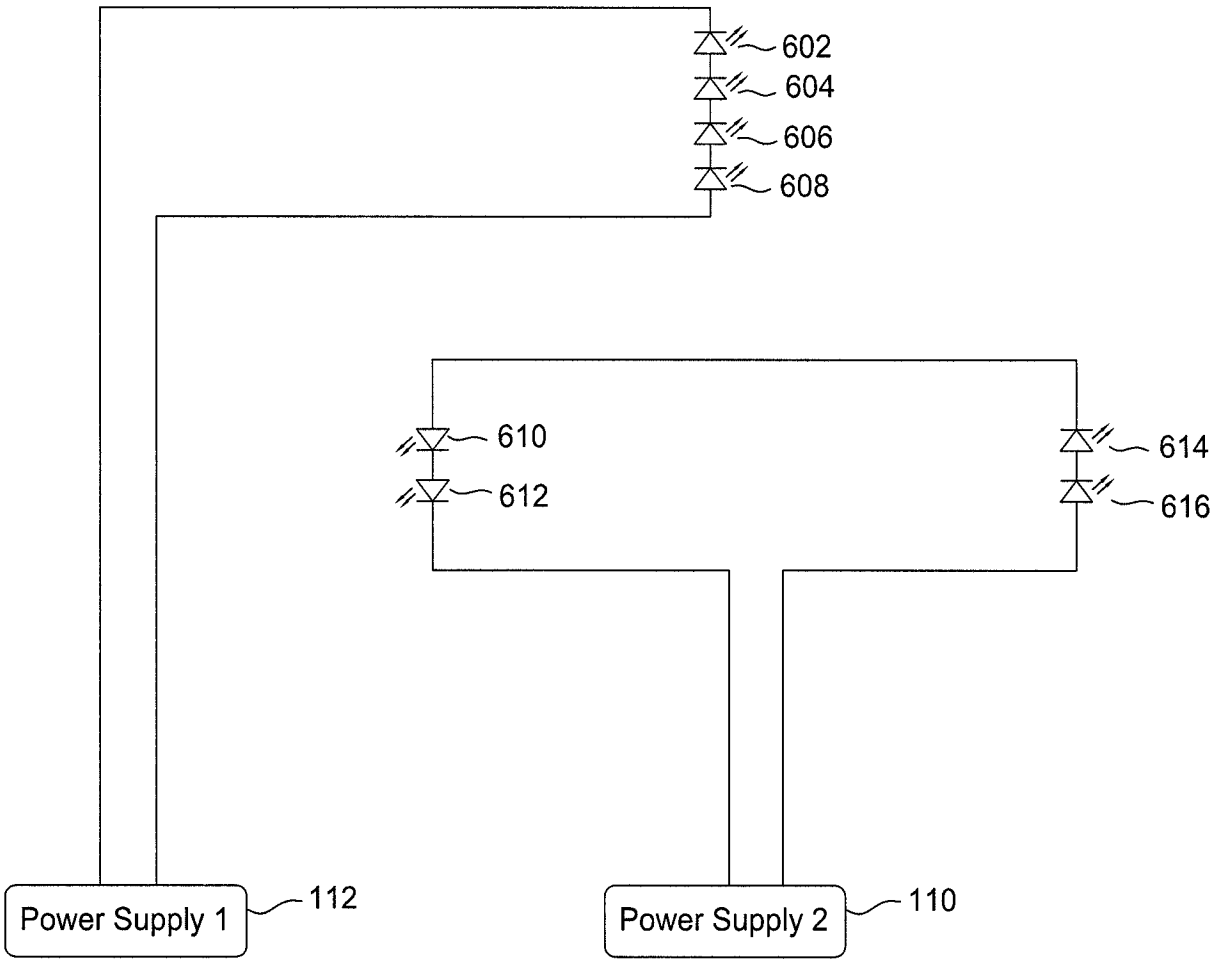
FIG. 6 depicts a second example wiring diagram of the LEDs in the obstruction lighting system.

FIG. 6 illustrates how in one embodiment, the LEDs 610-616 of the obstruction light beacons 102 and 104 may be electrically connected in series to the single or master power supply 110 using a single set of wires 114. In FIG. 5, a wire out of the power supply 110 may be run through both obstruction light beacons 102 and 104 and back to the power supply 110. The wiring configuration in FIG. 4 allows a failure or outage of any one of the obstruction light beacons 102 and 104 to be detected.

Figure 7:
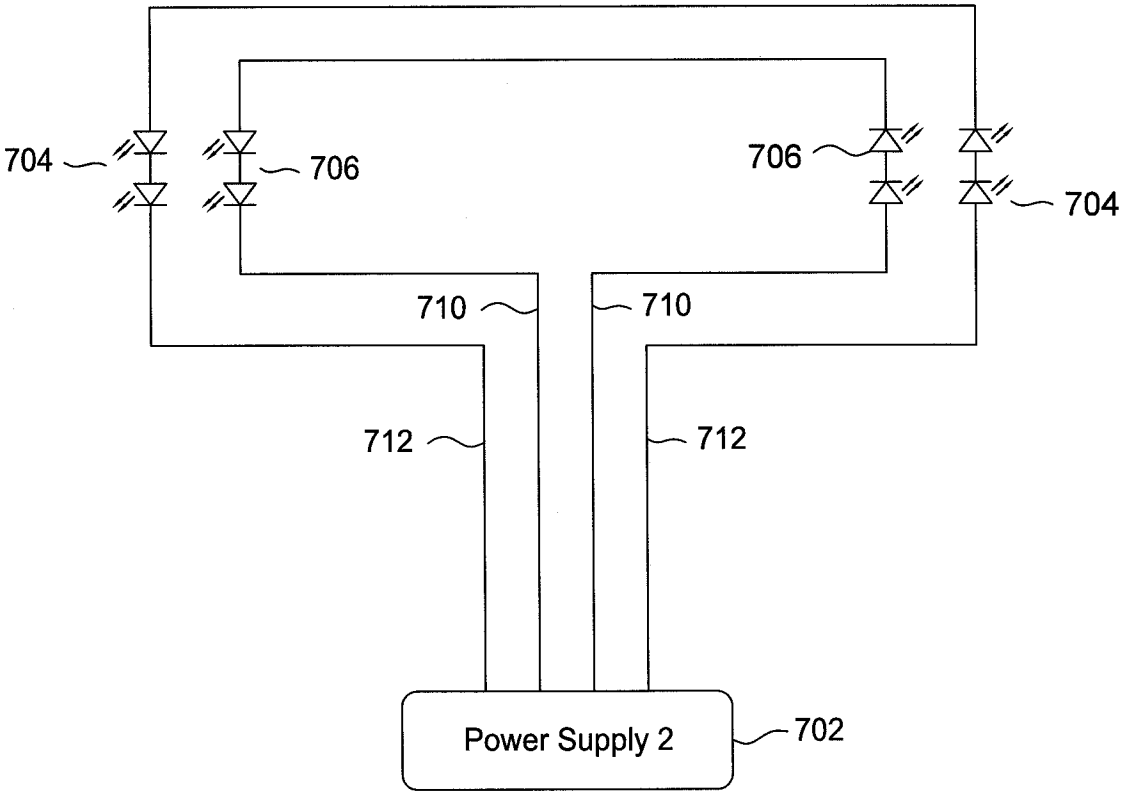
FIG. 7 depicts a third example wiring diagram of the obstruction light beacons in the obstruction lighting system.

FIG. 7 illustrates an alternate embodiment of a wiring diagram of the obstruction light beacons wherein two sets of LEDs 704 and 706 may be employed. The LEDs 704 and 706 may have different characteristics, such as for example, a different color. For example, the LED(s) 704 may emit white light (white light output) for day time operation, whereas the LED(s) 706 may emit red light (red light output) for night time operations. The white light emitting LEDs may be driven by a single set of wires for both obstruction light beacons 102 and 104. For both obstruction light beacons 102 and 104, the red light emitting LEDs may also be driven by a single set of wires different from the single set of wires driving the white LEDs. In one embodiment, the obstruction light beacons LEDs 704 and 706 may each be electrically connected in series separately to the single or common power supply 702 using a multiple set of wires 710 and 712. The wiring configuration in FIG. 7 allows a failure or outage of any one of the obstruction light beacons 102 and 104 to be detected. In another embodiment, the obstruction light beacons LEDs 704 and 706 may each be electrically connected in parallel separately to the single or common power supply 702 using a multiple set of wires 710 and 712.

In a further embodiment, three or more obstruction light beacons may be powered from a single power supply using a single set of wires. For example, obstruction light beacons 102, 104 and 106 may be powered from a single power supply using a single set of wires. In one embodiment, some electronics in addition to the power supply electronics may by located in the obstruction light beacons. In one embodiment, constant current regulator electronics may by located in the obstruction light beacons. In this case a constant AC or DC voltage may be supplied to the obstruction light beacons 102, 104 and 106 in a series or parallel configuration.

Figure 8:
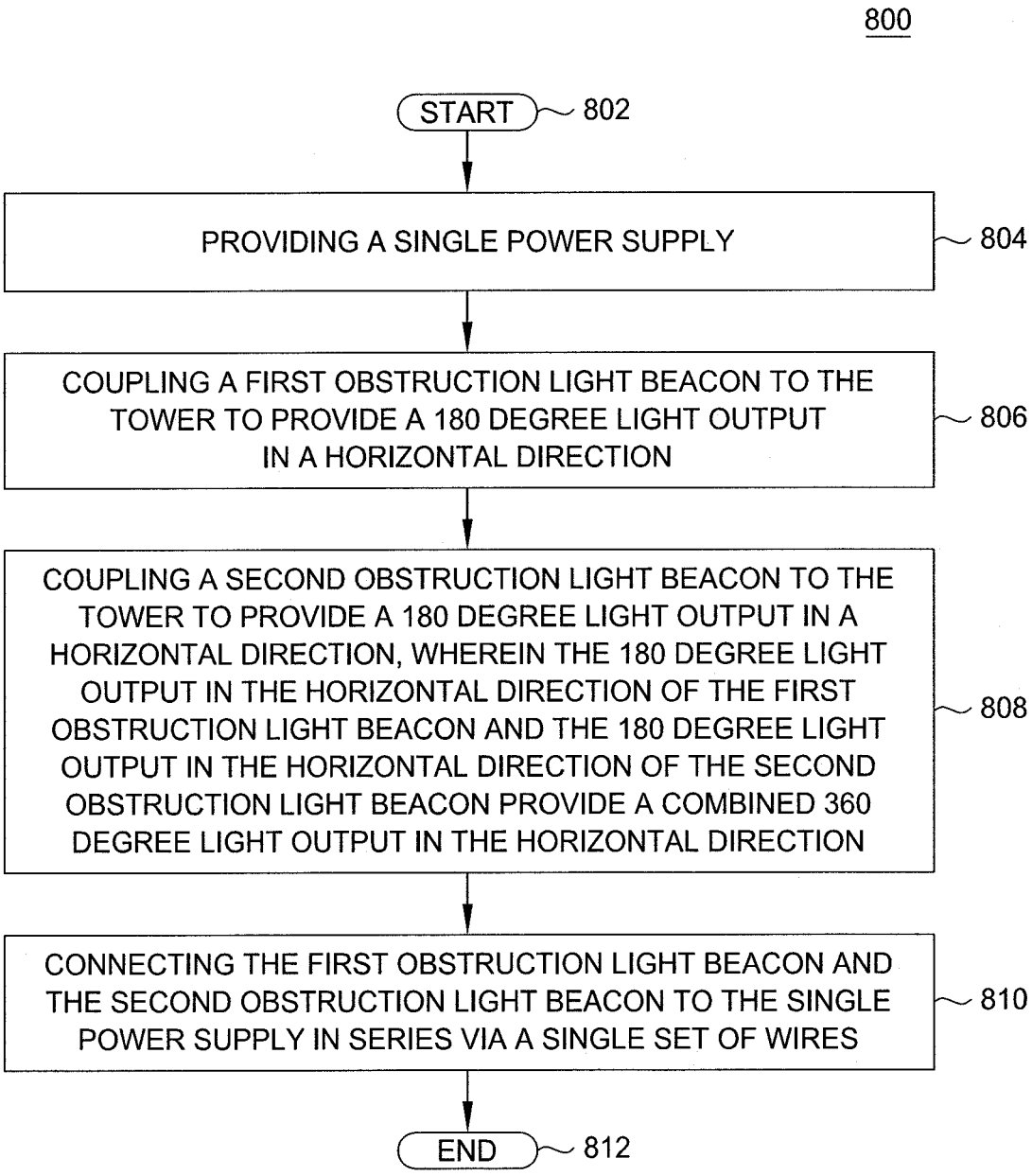
FIG. 8 depicts an example flow diagram of a method for providing obstruction lighting on a tower.

FIG. 8 illustrates an example flowchart of one embodiment of a method 800 for providing obstruction lighting to a tower. The method 800 begins at step 802. At step 804, the method 800 provides a single power supply.

At step 806, the method 800 couples a first obstruction light beacon to the tower to provide a 180 degree light output in the horizontal direction. The first obstruction light beacon may be an obstruction light beacon similar to the obstruction light beacons 102 or 104 described above. The tower may be an "E-2" type tower as define by the FAA.

At step 808, the method 800 couples a second obstruction light beacon to the tower to provide a 180 degree light output in a horizontal direction, wherein the 180 degree light output in the horizontal direction of the first obstruction light beacon and the 180 degree light output in the horizontal direction of the second obstruction light beacon provide a combined 360 degree light output in the horizontal direction. The second obstruction light beacon may be an obstruction light beacon similar to the obstruction light beacons 102 or 104 described above.

In one embodiment, an alignment feature on both the first obstruction light beacon and the second obstruction light beacon may be used to align the first and second obstruction light beacons. In one embodiment, the alignment feature may be a cooperative alignment feature. In other words, the cooperative alignment feature may be a feature on each one of the obstruction light beacons that work together, e.g., an arrow or other linear mark, that points to each other on the same line, a laser level on one obstruction light beacon and a receiver on another obstruction beacon light, and the like.

In one embodiment, the alignment feature may be an independent alignment feature. In other words, the obstruction light beacons may be independently aligned without the need of each alignment feature on each one of a plurality of obstruction light beacons to work together. For example, the independent alignment feature may be a non-optical indicator. Thus, an installer only needs to point the non-optical indicator in the proper direction to ensure the obstruction light beacon is properly aligned, irrespective of how the other obstruction light beacons are aligned or whether other obstruction light beacons are visible around the tower.

At step 810, the method 800 connects the first obstruction light beacon and the second obstruction light beacons to the single power supply in series via a single set of wires. The electrical connection may be configured as illustrated in FIGS. 3-7. The method 800 ends at step 812.

While various embodiments have been described above, it should be understood that they have been presented by way of example only, and not limitation. Thus, the breadth and scope of a preferred embodiment should not be limited by any of the above-described exemplary embodiments, but should be defined only in accordance with the following claims and their equivalents.

What is claimed is:

1. An obstruction lighting system for an elevated structure, comprising:

two obstruction light beacons that provide at least 1,500 candelas (cd) of light output, wherein each one of the two obstruction light beacons comprises a plurality of light emitting diodes (LEDs) and at least one optic, wherein each one of the two obstruction light beacons provides at least a 180 degree light output in a horizontal direction for being operated together to provide a combined 360 degree light output in a horizontal direction, wherein the at least one optic collimates light in a vertical axis to create a beam spread in the vertical axis of between 3 and 6 degrees, wherein a light intensity at 0 degrees vertical and +/−90 degrees horizontal is between 30% and 70% of the light intensity at 0 degrees vertical and 0 degrees horizontal for each one of the two obstruction light beacons, wherein the light intensity at 0 degrees vertical and 180 degrees horizontal is less than 10% of the light intensity at 0 degree vertically and 0 degrees horizontally for each one of the two obstruction light beacons; and a single power supply for providing power to the two obstruction light beacons using a single set of wires that connects the two obstruction light beacons.

2. The obstruction lighting system of claim 1, wherein the obstruction lighting system further comprises:

a monitor for detecting a failure of an LED of the plurality of LEDs of each one of the two obstruction light beacons.

3. The obstruction lighting system of claim 1, wherein each one of the two obstruction light beacons includes an alignment feature.

4. The obstruction lighting system of claim 3, wherein the alignment feature ensures that the 360 degree light output in the horizontal direction is achieved.

5. The obstruction lighting system of claim 3, wherein the alignment feature comprises an alignment linear mark on a top side of each one of the two obstruction light beacons.

6. The obstruction lighting system of claim 3, wherein the alignment feature comprises a non-optical indicator.

7. The obstruction lighting system of claim 1, wherein the single power supply provides a constant current to the two obstruction light beacons.

8. The obstruction lighting system of claim 7, wherein the constant current is an identical value for the two obstruction light beacons.

9. The obstruction lighting system of claim 1, wherein each one of the two obstruction light beacons has two different sets of the plurality of LEDs powered by two different wire sets and provides two different light outputs.

10. The obstruction lighting system of claim 9, wherein the two different sets of the plurality of LEDs comprise two different colors.

11. The obstruction lighting system of claim 1, wherein the plurality of LEDs of the two obstruction light beacons is wired together in a series configuration.

12. The obstruction light system of claim 1, wherein each one of the two obstruction light beacons comprises the plurality of LEDs arranged in a plurality of light emitting diode (LED) arrays.

13. The obstruction light system of claim 12, wherein each one of the plurality of LED arrays comprises the plurality of LEDs arranged on approximately a line.

14. The obstruction lighting system of claim 1, wherein the plurality of LEDs of the two obstruction light beacons is wired together in a parallel configuration.

15. A method of providing obstruction lighting on an elevated structure, comprising:

providing a single power supply;

coupling a first obstruction light beacon to the elevated structure to provide a 180 degree light output in a horizontal direction;

coupling a second obstruction light beacon to the elevated structure to provide a 180 degree light output in a horizontal direction, wherein the 180 degree light output in the horizontal direction of the first obstruction light beacon and the 180 degree light output in the horizontal direction of the second obstruction light beacon provides a combined 360 degree light output in the horizontal direction, wherein the coupling the second obstruction light beacon to the elevated structure comprises aligning an alignment feature of the second obstruction light beacon to an alignment feature of the first obstruction light beacon, wherein the alignment feature comprises a linear mark on a top side of each one of the first obstruction light beacon and the second obstruction light beacon; and connecting the first obstruction light beacon and the second obstruction light beacon to the single power supply in series via a single set of wires.

16. A method of providing obstruction lighting on an elevated structure, comprising:

providing a single power supply;

coupling a first obstruction light beacon to the elevated structure to provide a 180 degree light output in a horizontal direction;

coupling a second obstruction light beacon to the elevated structure to provide a 180 degree light output in a horizontal direction, wherein the 180 degree light output in the horizontal direction of the first obstruction light beacon and the 180 degree light output in the horizontal direction of the second obstruction light beacon provides a combined 360 degree light output in the horizontal direction, wherein the coupling the second obstruction light beacon to the elevated structure comprises aligning an alignment feature of the second obstruction light beacon to an alignment feature of the first obstruction light beacon, wherein the alignment feature comprises a non-optical indicator on each one of the first obstruction light beacon and the second obstruction light beacon; and connecting the first obstruction light beacon and the second obstruction light beacon to the single power supply in series via a single set of wires.

* * * * *